US009885150B2

(12) United States Patent
Mennucci et al.

(10) Patent No.: US 9,885,150 B2
(45) Date of Patent: Feb. 6, 2018

(54) SHOE PRESS

(71) Applicant: TOSCOTEC S.p.a., Marlia (LU) (IT)

(72) Inventors: Giovan Battista Mennucci, Lucca (IT); Francesco Simoncini, Lucca (IT); Stefano Baldi, Lucca (IT); Francesco Possenti, Livorno (IT); Enrico Raffanti, S. Vito-Lucca (IT); Paolo Raffaelli, Lucca (IT)

(73) Assignee: TOSCOTEC S.p.a., Marlia (LU) (IT)

( * ) Notice: Subject to any disclaimer, the term of this patent is extended or adjusted under 35 U.S.C. 154(b) by 70 days.

(21) Appl. No.: 14/889,607

(22) PCT Filed: Apr. 7, 2014

(86) PCT No.: PCT/IT2014/000101
§ 371 (c)(1),
(2) Date: Nov. 6, 2015

(87) PCT Pub. No.: WO2014/181366
PCT Pub. Date: Nov. 13, 2014

(65) Prior Publication Data

US 2016/0083903 A1 Mar. 24, 2016

(30) Foreign Application Priority Data

May 9, 2013 (IT) ..... FI2013A0106

(51) Int. Cl.
*D21F 3/02* (2006.01)
*B30B 5/04* (2006.01)

(52) U.S. Cl.
CPC ..... *D21F 3/0218* (2013.01); *B30B 5/04* (2013.01)

(58) Field of Classification Search
CPC ..... D21F 3/02; D21F 3/0218; D21F 3/0209; B30B 3/02; B30B 9/20; B30B 5/02; B30B 5/04
(Continued)

(56) References Cited

U.S. PATENT DOCUMENTS 4,917,767 A * 4/1990 Ilmarinen ..... D21F 3/0218 100/153
6,030,502 A * 2/2000 Meschenmoser ..... D21F 3/0218 162/358.3

FOREIGN PATENT DOCUMENTS

DE 10 2006 021428 A1 11/2007
DE 10 2009 000425 A1 7/2010
(Continued)

OTHER PUBLICATIONS

EP 1959052, Aug. 2008, English language machine translation, www.epo.org.*

*Primary Examiner* — Eric Hug
(74) *Attorney, Agent, or Firm* — McGlew and Turtle, P.C.

(57) ABSTRACT

Shoe press comprising a fixed support structure (2, 10), a flexible belt (1) rotating about said fixed support structure (2, 10) which flexible belt (1) can be pushed against a bearing element (4) to define a pressure nip (N), a shoe (3) connected with the fixed support structure (2, 10) and arranged with respect to the belt (1) so as to push the latter towards the bearing element (4) in correspondence of the nip (N) by effect of a pressure exerted on the same shoe (3) by corresponding loading means. The loading means are constituted by hydraulic cylinders each of which has a chamber (90) formed by a corresponding passing hole formed in the fixed support structure (2, 10) and a rod (91) which on one side is free to slide inlaid hole and on the other side transmits pressure to the shoe (3).

18 Claims, 10 Drawing Sheets

(58) Field of Classification Search
USPC ..... 162/358.3
See application file for complete search history.

(56) References Cited

FOREIGN PATENT DOCUMENTS

| | | | | |
|---|---|---|---|---|
| EP | 1959052 | * | 8/2008 | ..... D21F 3/0218 |
| EP | 2 123 825 A1 | | 11/2009 | |

* cited by examiner

SHOE PRESS

The present invention relates to a shoe press and the use of such a press in the paper production.

It is known that the press section of a paper machine for the production of paper has the purpose to drain the maximum amount of water present in the fibrous mass. The water that is not removed in the press section must be removed by evaporation in a dryer.

Thus, greater efficiency of the press section leads to lower energy consumption in the evaporation process that takes place in the dryer. The presses also have the purpose of dehydrating the sheet as evenly as possible over the entire length of the pressing line ("nip"). In its simplest form, the press section comprises two rollers forming a nip through which pass the paper material and a felt designed to absorb the water ejected from the paper due to the pressure exerted by the two rollers.

In a shoe press, one of the two rollers is replaced by a tubular belt having a metal structure inside. Inside said metallic structure is placed a beam that supports at least one shoe, i.e. a body shaped in such a way as to copy the curvature of the roller or "Yankee" coupled with it. The shoe is connected with so-called "loading" hydraulic means that serve to push the same shoe against the coupled roller to compress the paper that passes through the thus formed nip.

EP2123825 discloses a shoe press comprising loading means formed by hydraulic pistons sliding in chambers that are open on top and closed on their bottom.

In general, a shoe press is more efficient than roller presses but is still strongly felt the need to simplify the construction of the shoe presses, also for reducing the production cost, and to have a wider range of models to meet the current production needs.

The main purpose of the present invention is to propose a shoe press that meets the requirements mentioned above.

This result is achieved, according to the present invention, by adopting the idea of realizing a device having the characteristics indicated in claim 1. Other features of the present invention are the subject of the dependent claims.

A shoe press in accordance with the present invention is particularly simple from the constructive point of view, especially in relation to the structure and operation of the loading means. The simple construction of the device reflects positively both on its manufacturing cost and on the costs related to the maintenance operations and possible replacement.

These and other advantages and features of the present invention will be best understood by anyone skilled in the art from the following description and from the accompanying drawings, given by way of example but not to be considered in a limiting sense, in which.

Figure 1:
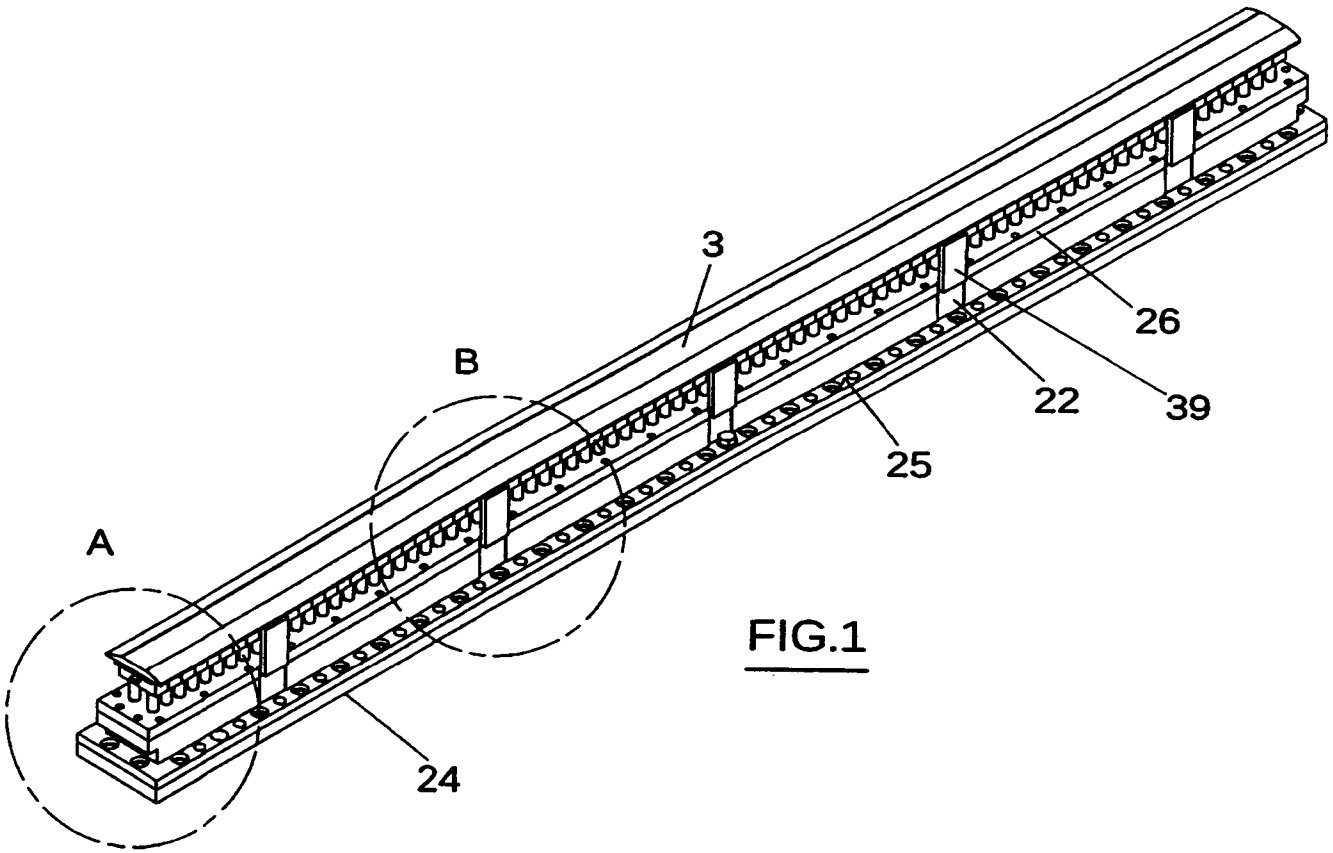
FIG. 1 is a schematic perspective view of a shoe press in accordance with the invention with the shoe in the loaded state.
Figure 2:
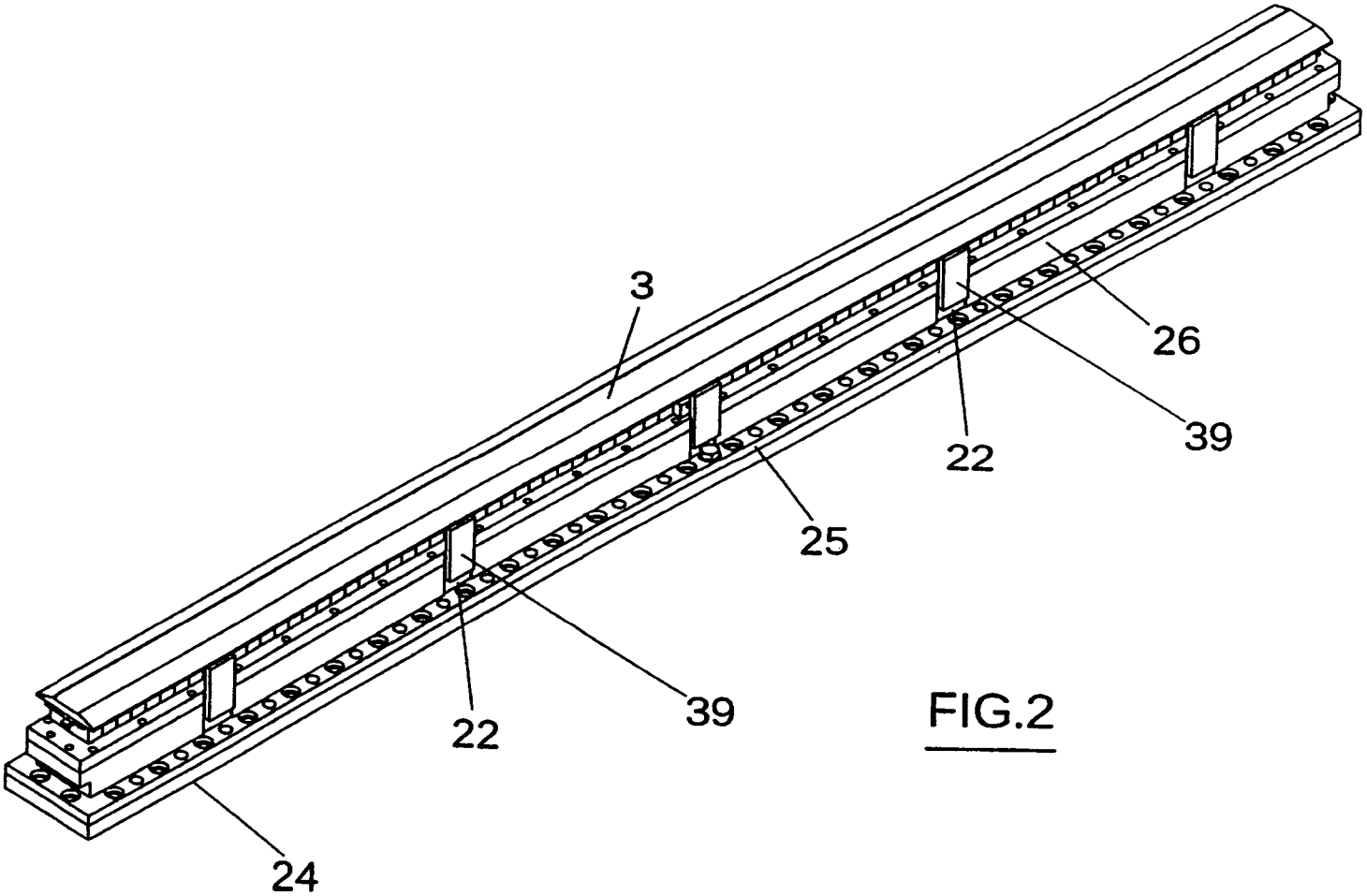
FIG. 2 is a schematic perspective view of the shoe press of FIG. 1 with the shoe in the unloaded state.
Figure 5:
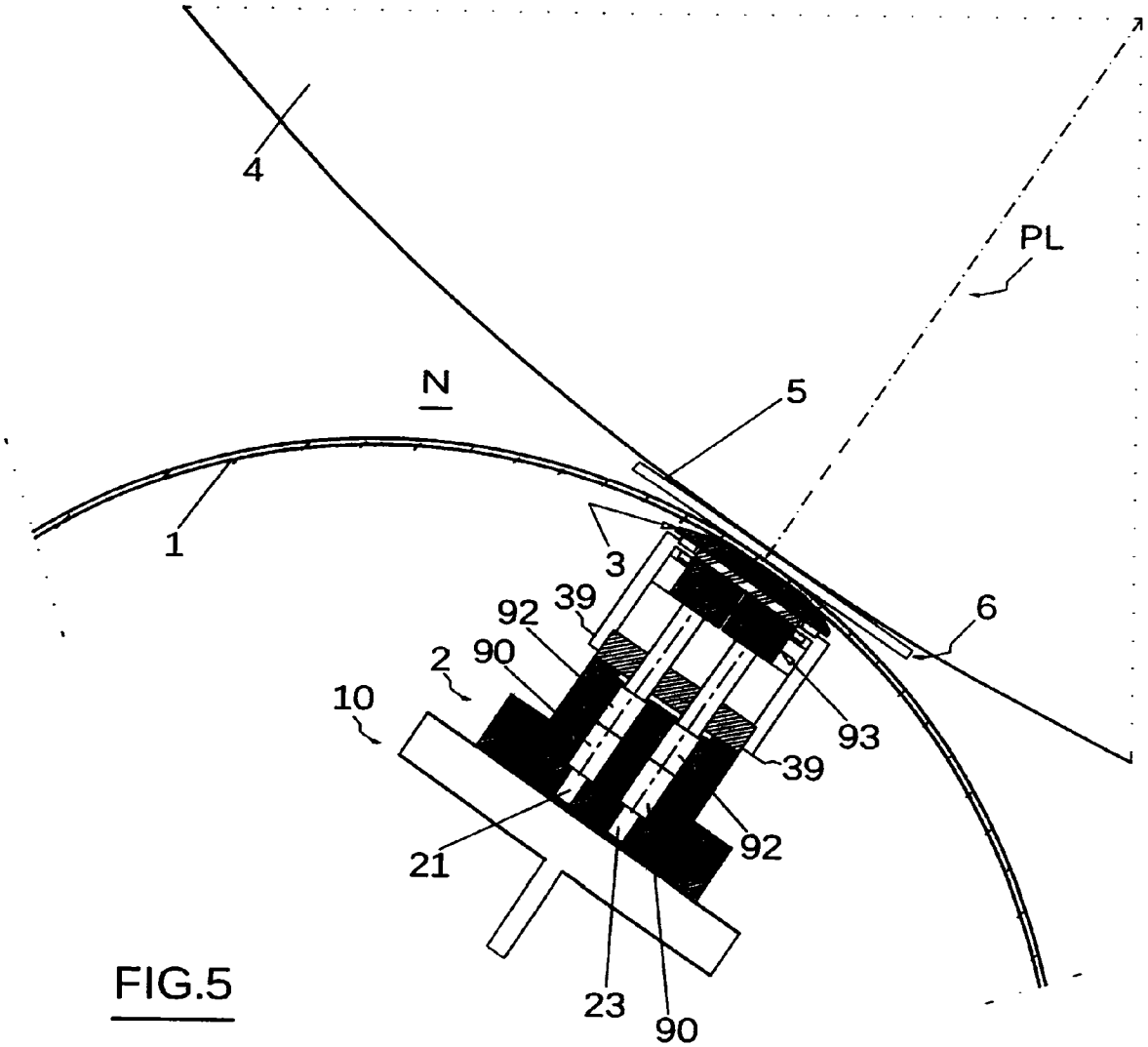
Figure 7:
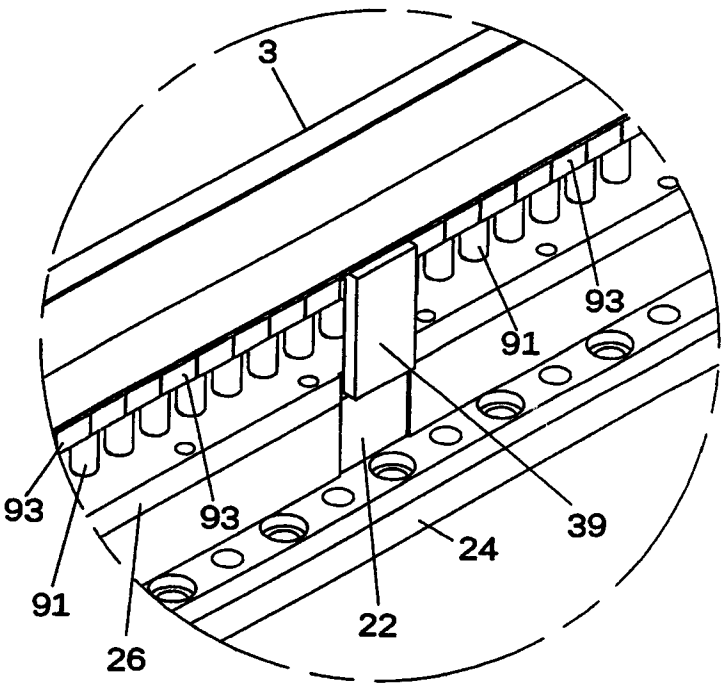
Figure 6:
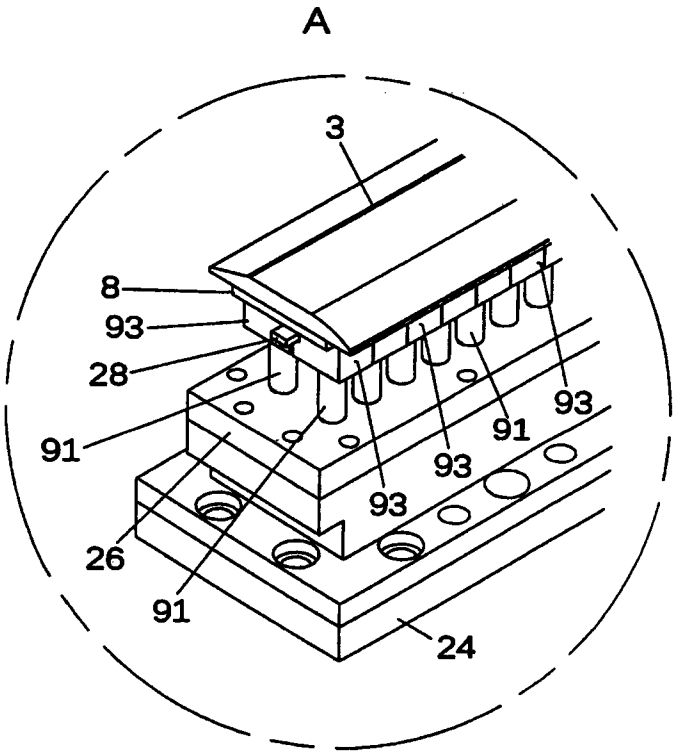
Figure 8:
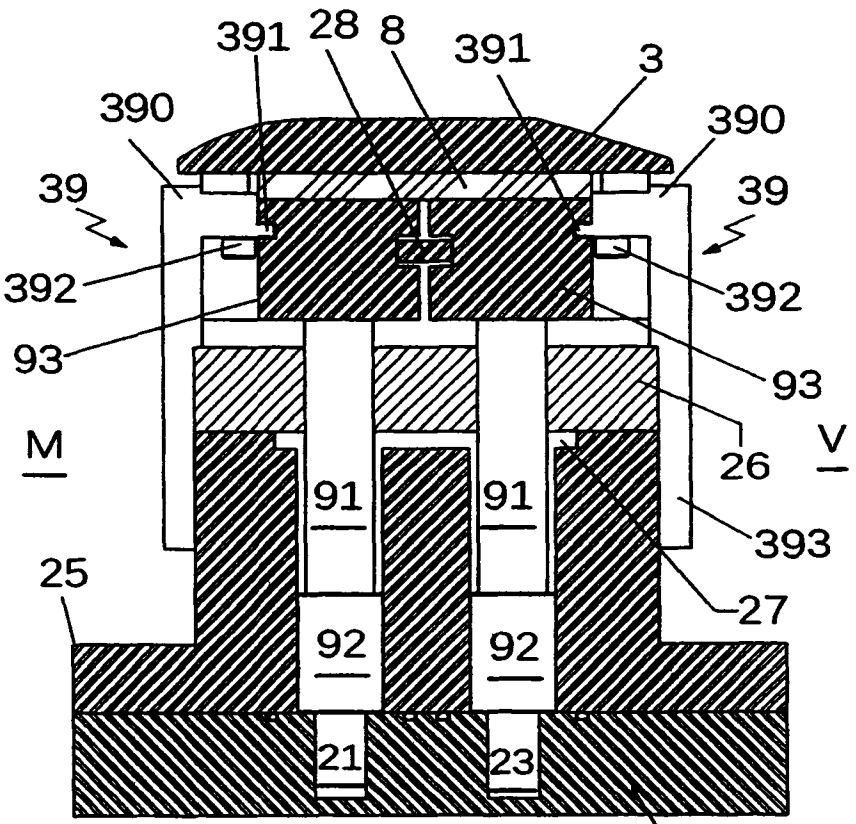
Figure 9:
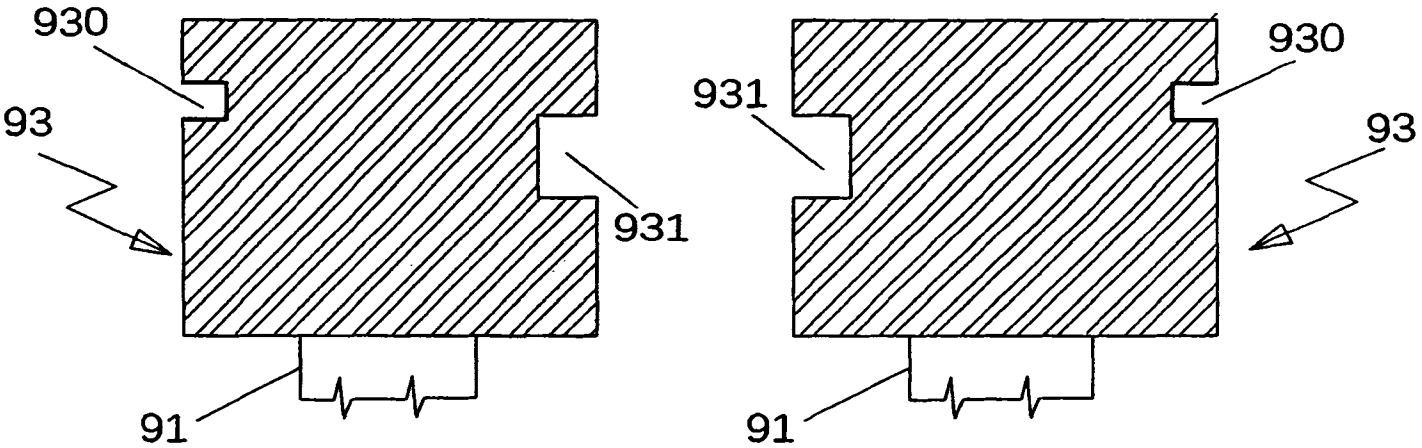
Figure 10:
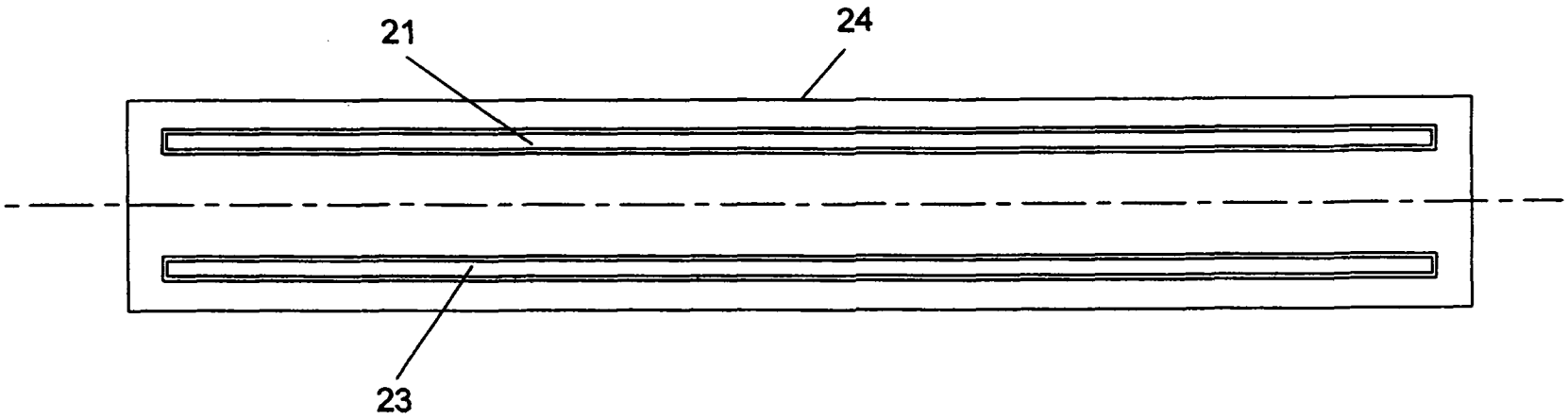
Figure 11:
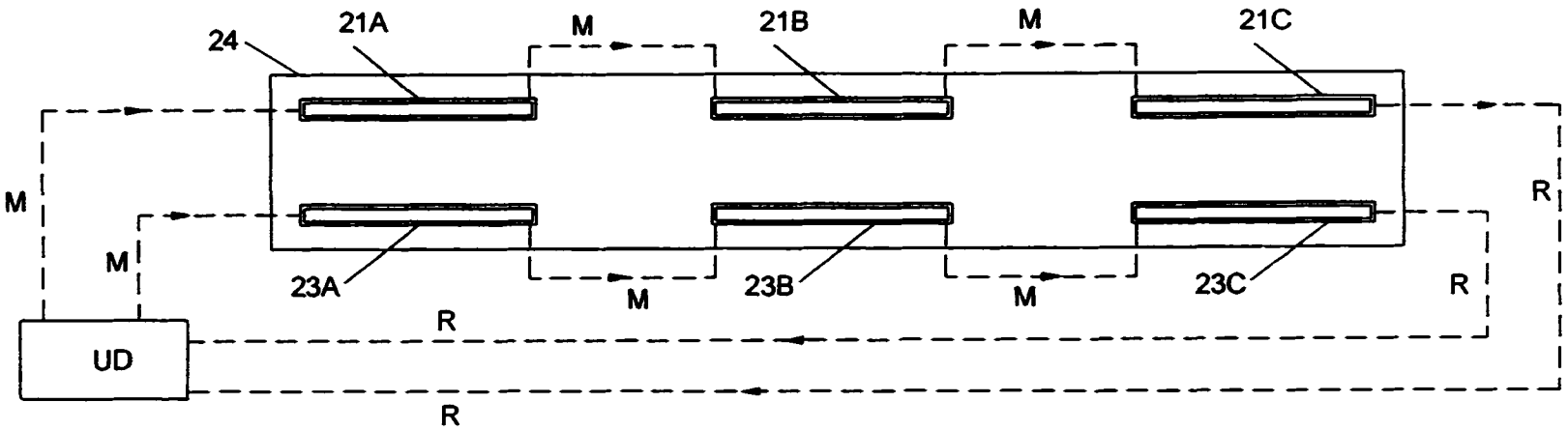
Figure 12:
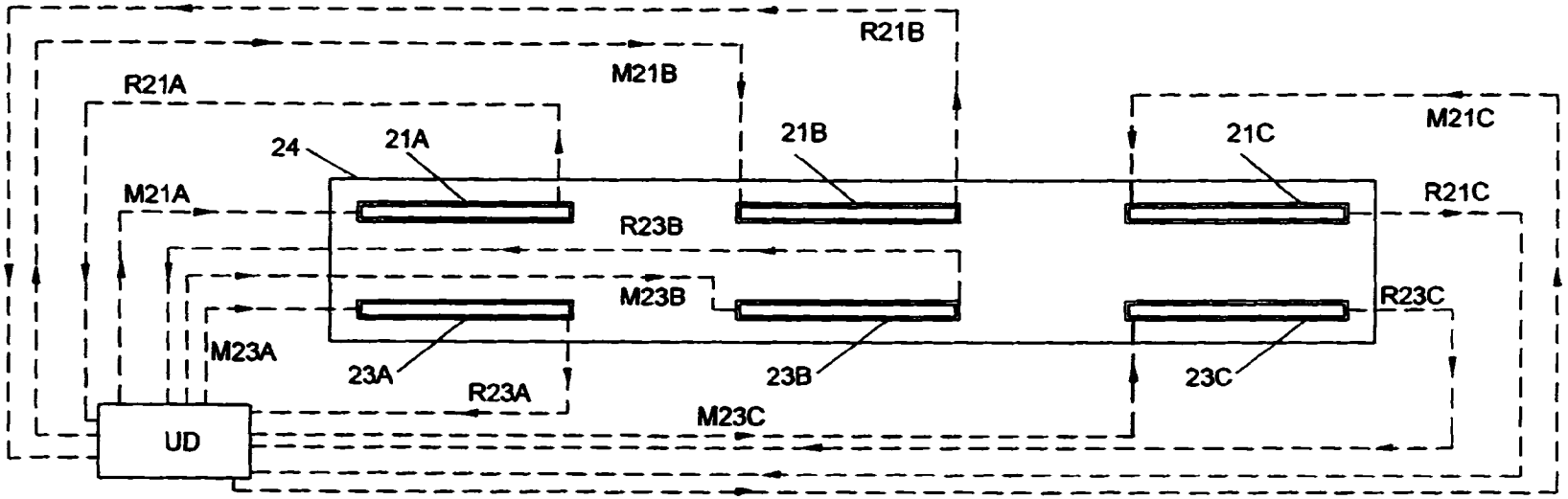

FIG. 5 schematically shows a shoe press in accordance with the invention in a working state;

FIG. 6 represents an enlargement of the detail "A" of FIG. 1;

FIG. 7 represents an enlargement of the detail "B" of FIG. 1;

FIG. 8 is a further cross-sectional view of the shoe press of FIG. 2;

FIG. 9 shows a detail of FIG. 8, showing only the heads of two hydraulic pistons arranged side by side;

FIG. 10 is a schematic top plan view of the lower body (24) of the support (2) according to a first embodiment;

FIG. 11 is a schematic top plan view of the lower body (24) of the support (2) according to a further embodiment;

FIG. 12 is a schematic top plan view of the lower body (24) of the support (2) in accordance with a third embodiment.

Reduced to its essential structure and with reference to the attached drawings, a shoe press in accordance with the present invention is of the type comprising a tubular belt (1) associated with a fixed internal metal structure (10) known to the skilled in the art and partially illustrated in FIG. 5.

On said metallic structure (10) is fixed a support element (2) to which is connected a shoe (3), i.e. a body predominantly developed according a longitudinal direction and shaped in such a way as to conform to the curvature of a coupled cylinder that, in particular, is a Yankee cylinder (4). The connection between the support (2) and the shoe (3) is disclosed below.

The shoe (3) is placed above the support (2) and is served by hydraulic loading means that serve to push it against the Yankee cylinder (4) to compress the paper (5) which passes through the nip (N) formed by the opposite surfaces of the same cylinder (4) and belt (1) under which is arranged the shoe (3).

The length of belt (1) is at least equal to the length of the shoe (3). Similarly, the lengths of structure (10) and support (2) are at least equal to the length of the shoe (3).

The support (2) and the shoe (3) are oriented parallel to the longitudinal axis of the Yankee cylinder (4) and, as shown in FIG. 5, the longitudinal centerline plane (PL) of the group formed by the support (2) and by the shoe (3) is oriented radially with respect to the Yankee dryer (4).

In FIG. 5 is shown a felt (6) destined to absorb the water expelled from the paper (5) due to the pressure thus exerted. The felt (6) passes into the nip (N) between the paper (5) and the belt (1).

Advantageously, the said loading means are constituted by hydraulic piston cylinders, preferably of the double effect type, arranged along two rows side by side and oriented parallel to the longitudinal direction of the support (2) and the shoe (3), with the axes (x) of the respective rods oriented perpendicularly to said direction so as to be parallel to the said plane (PL) in the operative state as schematically shown in FIG. 5. Each rod slides in a respective chamber (90).

More particularly, the chambers (90) are formed in the body of the support (2) that, for this purpose, is provided with passing holes arranged in two rows side by side as previously mentioned.

Each rod (91) has a foot (92) axially slidably mounted in the respective chamber (90) and an opposite head or upper base (93).

The lower face of the shoe (3) is directed towards the heads or top bases (93) of the rods (91), the upper face of the same shoe (3) being turned towards the Yankee cylinder (4).

The shoe (3) is connected to a predetermined number of said pistons by means of respective connecting bodies (39). For example, each of said bodies, as shown in FIG. 8, has a wing (390) (horizontal in the drawing) exhibiting an appendix (391) inserted in a corresponding outer recess (930) of a head (93) and is fixed to a corresponding edge of the lower side of the shoe (3) by means of a threaded pin (392). The said outer recess (930) is formed on the outer face of the heads (93), i.e. on the side of these facing a corresponding outer side (M, V) of the support (2). Each body (39) has, in addition, a second wing (393) (vertical in the drawing and developed under the horizontal wing 390) adapted to slide in a corresponding guiding groove (22) presented by the support (2).

Said connecting bodies (39) are oriented parallel to said plane (PL).

In practice, when the rods (91) are extracted, the shoe (3) is spaced from the underlying support (2) and, when the rods (91) are retracted, the shoe (3) is dragged towards the support (2), coming closer to it, by said connecting bodies (39). As previously mentioned, preferably, not all the hydraulic pistons in the same row are connected to the shoe (3). For example, the said connection can be made on only ten hydraulic pistons. It is also preferable to connect with each other, at predefined intervals, the heads (93) of two adjacent pistons, i.e. of two pistons belonging to two different rows but arranged side by side, to the shoe (3). Such an arrangement is shown in FIG. 8 and is described in more detail below. For example, the said connection can be made on only ten hydraulic pistons, five of which belong to one row and the other five belong to the other row.

Advantageously, between the shoe (3) and the upper base (93) of the rods (91) of the piston (9) is interposed a strip (8) of a material that is more deformable than the shoe (3), for example plastic material, for equalizing the pressure exerted by the pistons on the shoe (3). The presence of the said strip (8) also allows to compensate for any movement of the shoe (3) caused by possible deformations of the Yankee cylinder (4). The said strip (8) extends continuously along the entire bottom side of the shoe (3). Alternatively, the said strip (8) can be replaced by a series of aligned shorter strips of the same plastic material.

The support (2) has internal ducts (21, 23) for the supply of hydraulic fluid to the passing holes forming the chambers (90), with a supply duct (21, 23) for each row of chambers (90) so as to be able to supply the hydraulic fluid independently to each row of chambers (90) and so to differentiate, if desired, the pressure of the hydraulic fluid in each row.

The support (2) has, in addition, a third conduit (27) for supplying the hydraulic fluid on the opposite part of the ducts (21) and (23) with respect to the chambers (90).

As previously mentioned, it is also advantageously provided that the heads (93) of said hydraulic pistons are bound to each other by means of a metal bar (28) inserted with clearance between the same heads (93) that, for this purpose, have an internal recess (931) for the positioning of the bar (28), the internal recess (931) being provided on the inner faces of the heads (93), i.e. on the faces of the heads of a row of pistons facing the heads of the other row. In other words, the grooves (391) of the heads (93) through which passes the bar (28) are opposite each other since formed on the counterfacing sides of the heads (93) of the two rows of hydraulic pistons. The bar (28) is used to prevent excessive reciprocal movements of the heads (93) bound by it.

Said bar (28) is parallel to the shoe (3) and the support (2).

Advantageously, the said support (2) is formed by three overlapping elements (24, 25, 26): the first element (24) is the lower element of the group, namely the one in contact with the structure (10), and in said first element (24) are formed the ducts (21, 23) for feeding the hydraulic fluid; the second element (25) is placed above the first one (24) and inside it are formed the passing holes that constitute the aforementioned chambers (90) which are in communication with the ducts (21) and (23); the third element (26) is above the intermediate element (25) and is provided with holes in which slide the rods (91) of the pistons (9). This construction of the support (2) is particularly advantageous as it simplifies the assembly of the whole syrod. Furthermore, this construction involves the further advantage of allowing to increase the number of said hydraulic pistons, or the density of the loading means, i.e. as the number of pressure elements, as the chambers (90) are obtained directly in the support (2) and in particular in the intermediate element. Yet another advantage arising from this construction of the support (2) resides in the greater simplicity of realization of the third conduit (27).

The ducts (21) and (23) may be formed, for example, producing two continuous grooves on the inner face of the first element (24) as schematically shown in FIG. 10.

Alternatively, the ducts (21) and (23) may be formed making a plurality of discontinuous grooves on the inner face of the first element (24) as shown schematically in FIG. 11 and FIG. 12 in which the ducts of a row are indicated by references 21A, 21B and 21C and those of the other row are indicated by references 23A, 23B and 23C.

In FIG. 11 the conduits (21A, 21B, 21C) and respectively (23A, 23B, 23C) are fed by a distribution unit of the hydraulic fluid (UD) by means of corresponding supply (M) and recirculating ducts (R) shown by dashed lines.

In this case, the fluid pressure is the same in each of these ducts because the distribution unit (UD) simply handles the recirculation of the hydraulic fluid in the circuit thus produced.

In FIG. 12 the conduits (21A, 21B, 21C) and respectively (23A, 23B, 23C) are fed individually by the distribution unit (UD), so that the hydraulic fluid pressure can be adjusted separately for each of such conduits. The supply and recirculating ducts that connect the unit (UD) with the ducts (21A, 21B, 21C, 23A, 23B, 23C) are shown with dashed lines and are indicated by the references (M21A, M21B, M21C) and respectively (M23A, M23B, M23C).

Figure 4:
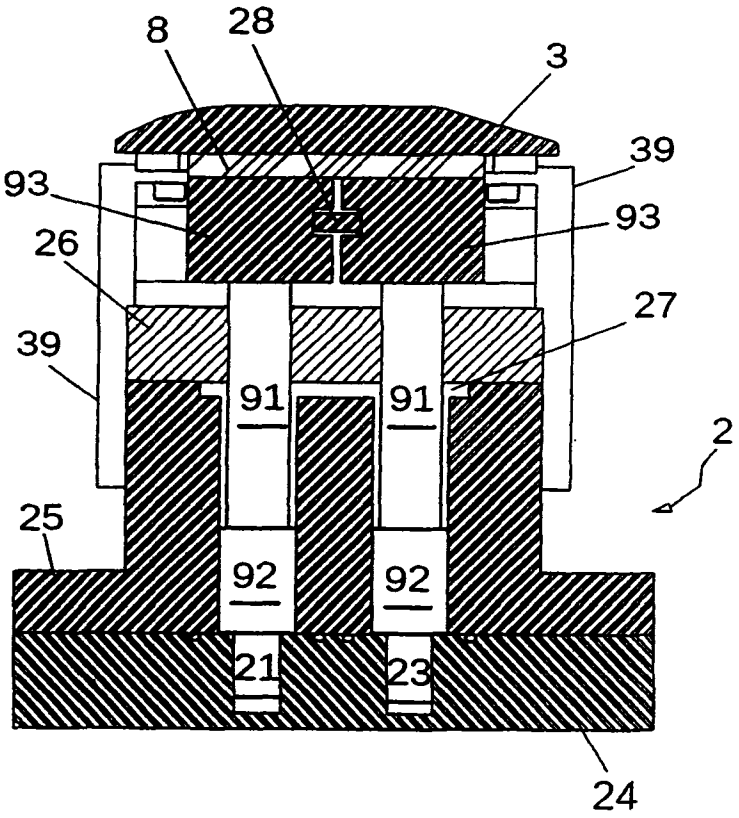
FIG. 4 is a schematic cross-sectional view of the shoe press of FIG. 2.
Figure 3:
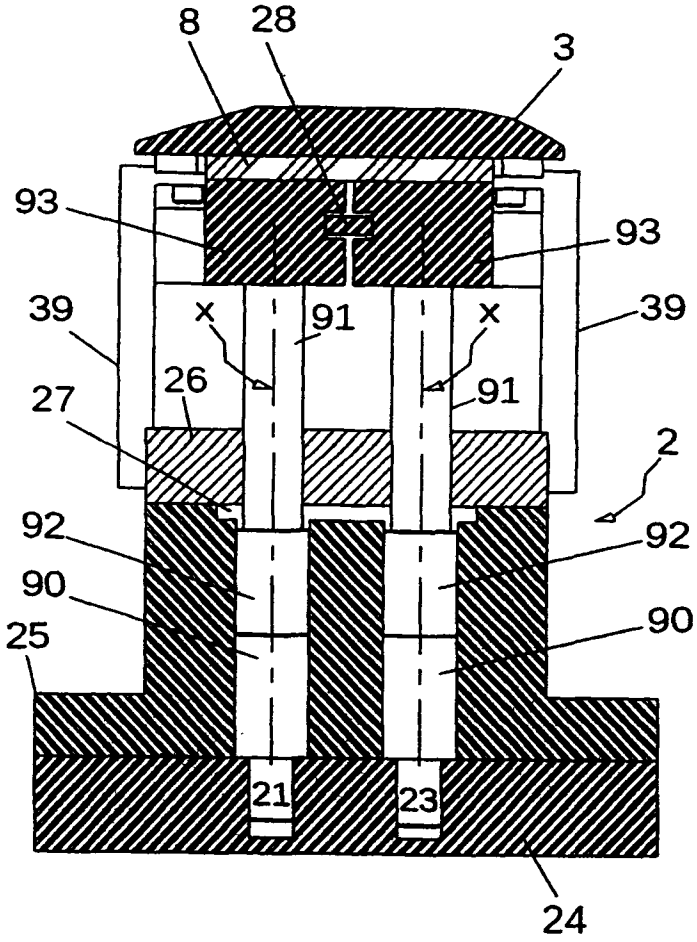
FIG. 3 is a schematic cross-sectional view of the shoe press of FIG. 1.

As previously stated, the shoe (3) is constrained to the support (2) in such a way as to be away from the latter when the rods of the pistons (9) are extracted (as shown in FIG. 1, FIG. 3 and FIG. 5) and respectively approaching when the rods of the pistons (9) are retracted (as in FIG. 2 and FIG. 4). In other words, when the rods of the pistons (9) are extracted, the shoe (3) is spaced from the support (2) for compressing the paper (5) that passes in the nip (N) in cooperation with the Yankee cylinder (4).

From the foregoing description it is evident that a shoe press in accordance with the present invention comprises a fixed support structure (2, 10), a flexible belt (1) rotating around the fixed support (10), which belt (1) can be pushed against a support element (4) to define a pressure nip (N), a shoe (3) constrained to the fixed support (2, 10) and arranged with respect to the belt (1) so as to push the latter towards the support element (4) in correspondence of the pressure nip (N) by effect of a pressure exerted on the same shoe (3) on the corresponding loading means, wherein said loading means are constituted by hydraulic pistons, each of which has a chamber (90) formed by a corresponding hole formed in the fixed support (2, 10) and a rod (91) which on one hand is free to slide in said hole and the other side is connected to the shoe (3).

In the embodiment described above, the fixed support structure comprises the element (2) and the structure (10), the support element is constituted by the Yankee cylinder (4) and the hydraulic pistons are preferably of the double effect type, actuated by hydraulic fluid entered in more supply conduits (21, 23, 27) formed in the element (2) of the fixed support structure.

In practice the details of execution may vary in any equivalent way as for what concerns the individual elements described and illustrated, as well as to their arrangement, without departing from the idea of the solution adopted and therefore remaining within the limits of the protection granted by this patent.

The invention claimed is:

1. A shoe press comprising:

a fixed support structure;

a flexible belt rotating about said fixed support structure which flexible belt can be pushed against a bearing element to define a pressure nip;

a shoe connected with the fixed support structure and arranged with respect to the belt so as to push the belt towards the bearing element in correspondence of the nip by effect of a pressure exerted on the shoe by corresponding loading means, said loading means comprising hydraulic cylinders, each of said hydraulic cylinder having a chamber formed by a corresponding passing hole formed in the fixed support structure and a rod which on one side is free to slide in said hole and on another side transmits pressure to the shoe, said hydraulic cylinders being arranged along a number of rows oriented parallel to a longitudinal direction of the fixed support, wherein said fixed support structure comprises a support element oriented parallel to the shoe and arranged below the shoe, said support element being made by superimposed bodies, with a first body, which is a lower body of the superimposed bodies and in which there are formed a plurality of feeding conduits for feeding a hydraulic fluid, with a second body that is placed above the first body in which there are multiple holes that constitute said chambers, the chambers being in communication with said conduits, and with a third body which is above the second body and is provided with holes in which said rods are free to slide, each of the feeding conduits feeding the hydraulic fluid to a respective row of the chambers.

2. A shoe press according to claim 1, wherein said hydraulic cylinders are arranged in two rows oriented parallel to a longitudinal direction of the fixed support structure and the shoe.

3. A shoe press according to claim 1, wherein said hydraulic cylinders are double acting type hydraulic cylinders.

4. A shoe press according to claim 1, wherein the shoe is constrained to the fixed support structure by a plurality of connecting bodies having a prevailing vertical development each of which at a side is fixed to a respective edge of the shoe and on an opposite side is inserted in a corresponding guiding groove provided on an outer side of the fixed support.

5. A shoe press according to claim 4, wherein said connecting bodies are applied on two opposite outer faces of the fixed support structure and the shoe.

6. A shoe press according to claim 1, wherein said second body and said third body delimit, in cooperation between said second body and said third body, a further duct for feeding a hydraulic fluid.

7. A shoe press according to claim 1, further comprising:

a strip of plastic material interposed between the shoe and said hydraulic pistons, said strip comprising a continuous or discontinuous element having a lower elastic modulus with respect to the shoe.

8. A shoe press according to claim 1, wherein each of said rods has a head portion through which said head portion transmits pressure to the shoe, said head portions being connected to each other.

9. A shoe press according to claim 8, wherein said head portions are mutually linked by a bar passing through recesses provided by the head portions at respective opposite inner sides.

10. A shoe press according to claim 1, wherein said hydraulic cylinders are fed through continuous conduits or discontinuous conduits.

11. A shoe press according to claim 1, wherein said conduits are formed by a discontinuous succession of ducts connectable with a distributor that feeds the ducts in a uniform manner or in a differentiated manner.

12. A shoe press according to claim 2, wherein said hydraulic cylinders are fed through continuous conduits or discontinuous conduits.

13. A shoe press according to claim 3, wherein said hydraulic cylinders are fed through continuous conduits or discontinuous conduits.

14. A shoe press according to claim 1, wherein said feeding conduits are formed by grooves provided on an inner surface of said first body.

15. A shoe press comprising:

a fixed support structure;

a flexible belt rotating about said fixed support structure which flexible belt can be pushed against a bearing element to define a pressure nip;

a shoe connected with the fixed support structure and arranged with respect to the belt so as to push the belt towards the bearing element in correspondence of the nip by effect of a pressure exerted on the shoe by corresponding loading means, said loading means comprising hydraulic cylinders, each of said hydraulic cylinder having a chamber formed by a corresponding passing hole formed in the fixed support structure and a rod which on one side is free to slide in said hole and on another side transmits pressure to the shoe, the shoe being constrained to the fixed support structure by a plurality of connecting bodies having a prevailing vertical development each of which at a side is fixed to a respective edge of the shoe and on an opposite side is inserted in a corresponding guiding groove provided on an outer side of the fixed support.

16. A shoe press according to claim 15, wherein said connecting bodies are applied on two opposite outer faces of the fixed support structure and the shoe.

17. A shoe press comprising:

a fixed support structure;

a flexible belt rotating about said fixed support structure which flexible belt can be pushed against a bearing element to define a pressure nip;

a shoe connected with the fixed support structure and arranged with respect to the belt so as to push the belt towards the bearing element in correspondence of the nip by effect of a pressure exerted on the shoe by corresponding loading means, said loading means comprising hydraulic cylinders, each of said hydraulic cylinder having a chamber formed by a corresponding passing hole formed in the fixed support structure and a rod which on one side is free to slide in said hole and on another side transmits pressure to the shoe, each of said rods having a head portion through which said head portion transmits pressure to the shoe, said head portions being connected with each other.

18. A shoe press according to claim 17, wherein said head portions are connected by a bar passing through recesses provided by the head portions at respective opposite inner sides.

* * * * *